US006220899B1

(12) United States Patent
Suzuki

(10) Patent No.: US 6,220,899 B1
(45) Date of Patent: Apr. 24, 2001

(54) ELECTRICAL CONNECTOR JACK FOR SECURELY HOLDING A PLUG

(75) Inventor: Yoshiaki Suzuki, Kitaibaraki (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/488,597

(22) Filed: Jan. 20, 2000

Related U.S. Application Data

(63) Continuation of application No. PCT/JP99/02598, filed on May 19, 1999.

(30) Foreign Application Priority Data

May 22, 1998 (JP) ..... 10-141038

(51) Int. Cl.[7] ..... H01R 24/00; H01R 24/04
(52) U.S. Cl. ..... 439/675; 439/669
(58) Field of Search ..... 439/188, 620, 439/676, 675, 668, 669, 345

(56) References Cited

U.S. PATENT DOCUMENTS 4,937,404 * 6/1990 Kitagawa ..... 200/51.09

* cited by examiner

*Primary Examiner*—Lincoln Donovan
*Assistant Examiner*—Chandrika Prasad
(74) *Attorney, Agent, or Firm*—Morrison Law Firm

(57) ABSTRACT

A connecting sleeve spring is resiliently mounted in a connecting sleeve of an electrical connecting jack. The connecting sleeve spring has a arcuate sinusoid-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar. In this way, the collar makes contact with the connecting sleeve spring at three points; the two ends and the center contact portion. This three point contact arrangement firmly holds and electrically connects the plug to the jack even if there is a gap between the collar and sleeve. The electrical connecting jack also includes a housing with a plurality of contact spring openings. A plurality of contact springs resiliently fit in these openings, electrically connecting the springs to the plug.

9 Claims, 4 Drawing Sheets

ELECTRICAL CONNECTOR JACK FOR SECURELY HOLDING A PLUG

This application is a continuation of PCT/JP99/02598 filed May 19, 1999, published as WO 99/62148 on Dec. 2, 1999.

BACKGROUND OF THE INVENTION

The present invention relates to an electrical connector jack. More specifically, it relates to a jack with a plug connecting sleeve spring disposed in the sleeve portion of the jack.

In the prior art, a conventional jack has a cylindrical sleeve portion with an opening into which a plug is inserted. The plug has a collar which fits over the sleeve electrically and mechanically connecting the sleeve to the collar.

A jack using the above plug and collar contact structure is disclosed in Japanese Unexamined Patent Publication No. 1-73899. The disclosed jack has a cylindrical collar which makes contact with a sleeve portion of a plug,. In order to ensure good electrical and physical contact, the sleeve portion must snugly fit against the collar. This requires accurate manufacturing, increasing the cost of producing the jack. Also, it is more difficult to ensure a snug fit when the jack miniaturized. In a cylindrical jack using the above disclosed snug fit connection, more material is required. This increases the weight of the jack and makes it more difficult to miniaturize.

OBJECTS AND SUMMARY OF THE INVENTION

It is an object of the present invention to provide a jack that solves the problems of the prior art.

It is another object of the present invention to provide a jack that does not require the dimensional accuracy of the prior art.

It is yet another object of the present invention to provide a jack which can be easily assembled.

It is another object of the present invention to provide a jack that can be miniaturized while maintaining good electrical characteristics.

Briefly stated, the present invention provides a connecting sleeve spring resiliently mounted in a connecting sleeve of an electrical connecting jack. The connecting sleeve spring has a arcuate sinusoidal-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar. In this way, the collar makes contact with the connecting sleeve spring at three points; the two ends and the center contact portion. This three point contact arrangement firmly holds and electrically connects the plug, to the jack even if there is a gap between the collar and sleeve. The electrical connecting jack also includes a housing with a plurality of contact spring openings. A plurality of contact springs resiliently fit in these openings, electrically connecting the springs to the plug.

According to an embodiment of the invention, there is provided an electrical connector jack comprising: a housing having a sleeve portion; the housing has a cavity axially disposed therein; the sleeve portion has a centrally disposed plug insertion opening communicating with the cavity whereby a plug is insertable therein; the plug has a collar axially disposed at one end; a plug connecting sleeve spring in the sleeve portion; means for resiliently holding the plug connecting sleeve spring in the sleeve portion; the plug connecting sleeve spring being generally arcuate; a central contact portion on the plug connecting sleeve spring; the plug connecting sleeve spring has a diameter centered on a longitudinal axis of the jack; a tongue on the central contact portion; the tongue is angled centrally inwards whereby the collar is partially aligned with the plug connecting sleeve spring when the collar is pushed against the tongue; the plug connecting sleeve spring has a first support piece at one end; and the plug connecting sleeve spring also has a second support piece at an other end whereby when the collar is fitted against the plug connecting sleeve spring, the central contact portion deforms inward towards the longitudinal axis forcing the first and second support pieces to move outward contacting the collar, firmly holding and electrically connecting the plug to the sleeve portion.

A-According to another embodiment of the invention, there is provided a connecting sleeve having a first diameter disposed on an electrical connector jack comprising: a plug insertion opening centrally disposed in the connecting sleeve the connecting sleeve has a first convex portion and a second convex portion; the connecting sleeve also has concave portion between the first and second convex portions; a connecting sleeve spring having a first support end and a second support end; the connecting sleeve spring has a central contact portion having a second diameter; the second diameter is smaller than the first diameter; the first support end has a third diameter; the second support has a fourth diameter; the third and fourth diameters are centered in a direction opposite the second diameters; the connecting sleeve spring is radially disposed in the connecting sleeve whereby the first support end fits in the first convex portion and the second support end fits in the second convex portion, resiliently holding the connecting sleeve spring in the connecting sleeve while leaving a gap between the central contact portion and the concave portion; a tongue on an end of the central contact portion facing the concave portion; and the tongue is angled inwards towards the plug insertion opening whereby a collar attached to a plug makes contact with the tongue, moving the central contact portion inward towards the gap, thus forcing the first and second support ends outward towards an inside periphery of the collar, firmly holding and electrically connecting the plug to the electrical connector jack.

According to another embodiment of the invention, there is provided an electrical connector jack comprising: a plug having an axially disposed collar; a housing having a plurality of contact spring openings therein; a plug receiving cavity axially disposed within the housing; a connecting sleeve having a first diameter on a plug insertion end of the housing; a plug insertion opening cent rally disposed on the plug insertion end of the plug receiving cavity; a plurality of contact springs resiliently affixed to the housing whereby each one of the plurality of contact springs makes resilient contact with the plug through one of the plurality of contact spring openings when the plug is inserted within the housing; the connecting sleeve has a first convex portion and a second convex portion; the connecting sleeve also has concave portion between the first and second convex portions; a connecting sleeve spring having a first support end and a second support end; the connecting sleeve spring has a central contact portion having a second diameter; the second diameter is smaller than the first diameter; the first support end has a third diameter; the second support has a fourth diameter; the third and fourth diameters are centered in a direction opposite the first and second diameters; the connecting sleeve spring is radially disposed in the connecting sleeve whereby the first support end fits in the first convex portion and the second support end fits in the second convex portion resiliently holding the connecting sleeve spring in the connecting sleeve, while leaving a gap between the central contact portion and the concave portion; a tongue on the plug insertion end of the central contact portion; and the tongue is angled inwards towards the concave portion whereby when the plug is inserted in the plug receiving cavity, the collar makes contact with the tongue moving the central contact portion inward towards the gap thus forcing the first and second support ends outward towards an inside periphery of the collar, firmly holding and electrically connecting the plug to the electrical connector jack.

According to yet another embodiment of the invention, there is provided a connecting sleeve for installation in an electrical connector jack comprising: a plug connecting sleeve spring resiliently lodged in a channel of the connecting sleeve; a terminal on the plug connecting sleeve spring; the terminal electrically connectable to an external contact; a tongue on a central portion of the plug connecting sleeve spring; the central portion being positioned for resiliently urged contact with a connecting portion of the plug inserted into the electrical connector jack; and the resiliently urged contact, forcing the central portion to flex while urging both ends of the plug connecting sleeve spring in an opposite direction toward a perimeter surface of the connecting portion, thereby firmly holding and electrically connecting the connecting portion to the connecting sleeve.

A jack according to the present invention includes a sleeve spring with a contact disposed on a part of the sleeve portion that faces outward. Accordingly, even if the sleeve spring is reduced in size, it is easy to operate. Assembly is also simplified because it is produced simply by punching and bending sheet metal.

Further, since the sleeve spring is arranged to have a three-points-contact structure which applies a resilient force equal to the force applied to deform a contact portion, firmly holding the plug to the jack. This structure does not require that the dimensions of the sleeve and collar be as dimensionally precise as is required by the prior art.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
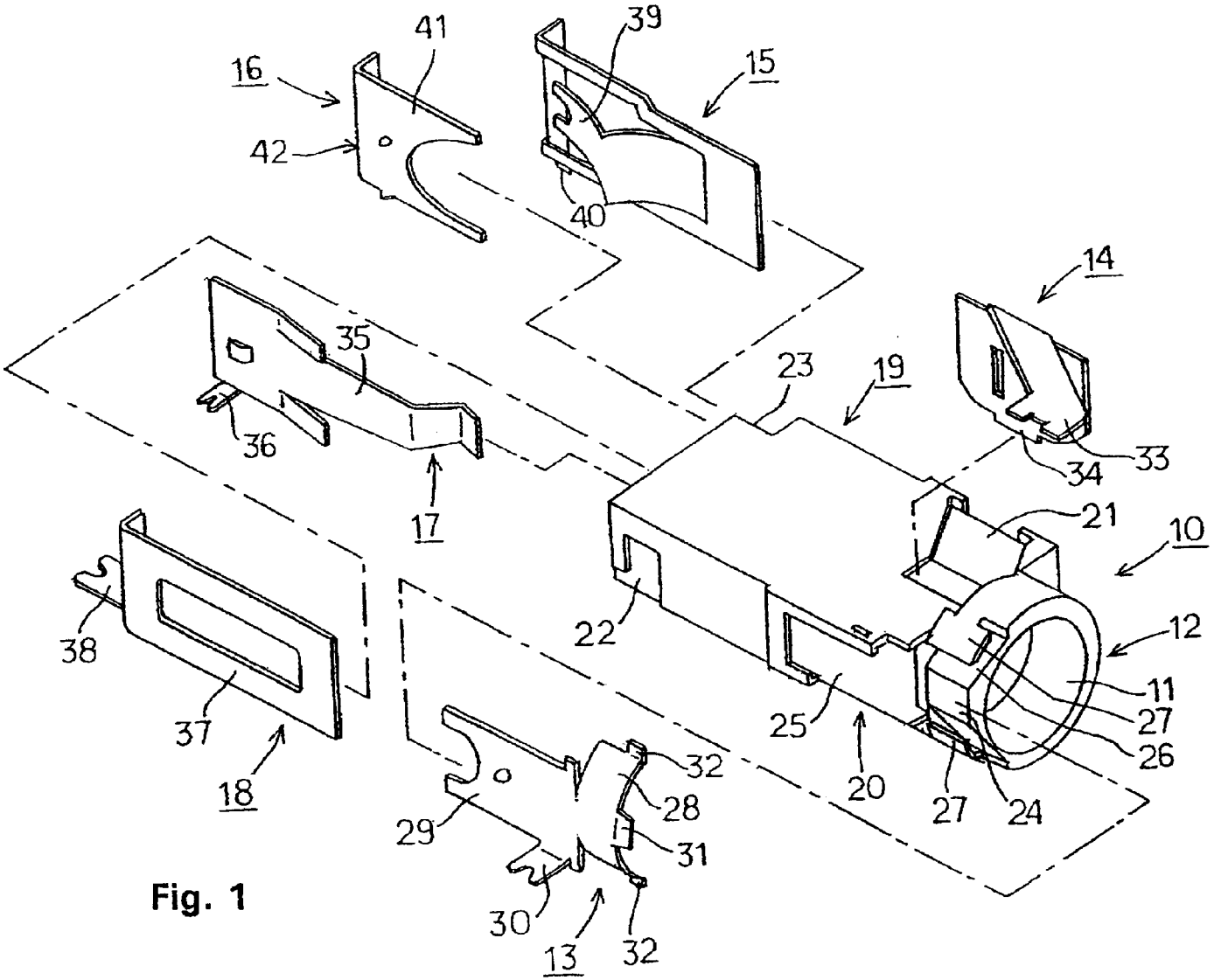
FIG. 1 is an exploded perspective view of a jack according to the present invention.

Referring to FIG. 1, a housing 10 includes a first sleeve spring 13 (also hereinafter referred to simply as sleeve spring 13) formed of a conductive material. A second sleeve spring 14 is disposed on an opposite side of housing 10. A chip spring 15 and a second terminal 16 are disposed along a right rear section of housing 10. A ring spring 17 and a first terminal 18 are disposed along a left rear section of housing 10. Housing 10 is substantially a rectangular-prism with a plug inserting hole 11 disposed therein. A first sleeve spring 13 is lockingly inserted in a body engaging portion 25 disposed along a left wall surface of housing 10. First sleeve spring 13 also lockingly engages a sleeve portion 12. Second sleeve spring 14 is lockingly inserted in a second sleeve engaging portion 21 disposed along a right wall surface of housing 10. Chip spring is lockingly inserted in a chip spring engaging portion 23 of housing 10 disposed along a rear right wall surface of housing 10. First terminal 1 8 is inserted from the rear side of ring spring 17. This provides the option for a three-point contact on a plug 45 when plug 45 is inserted in housing 10. One contact point optionally is provided by second sleeve spring 14, and the other two are optionally provided by chip spring 15 and ring spring 17. This arrangement provides a plurality of plug connection springs.

Figure 6:
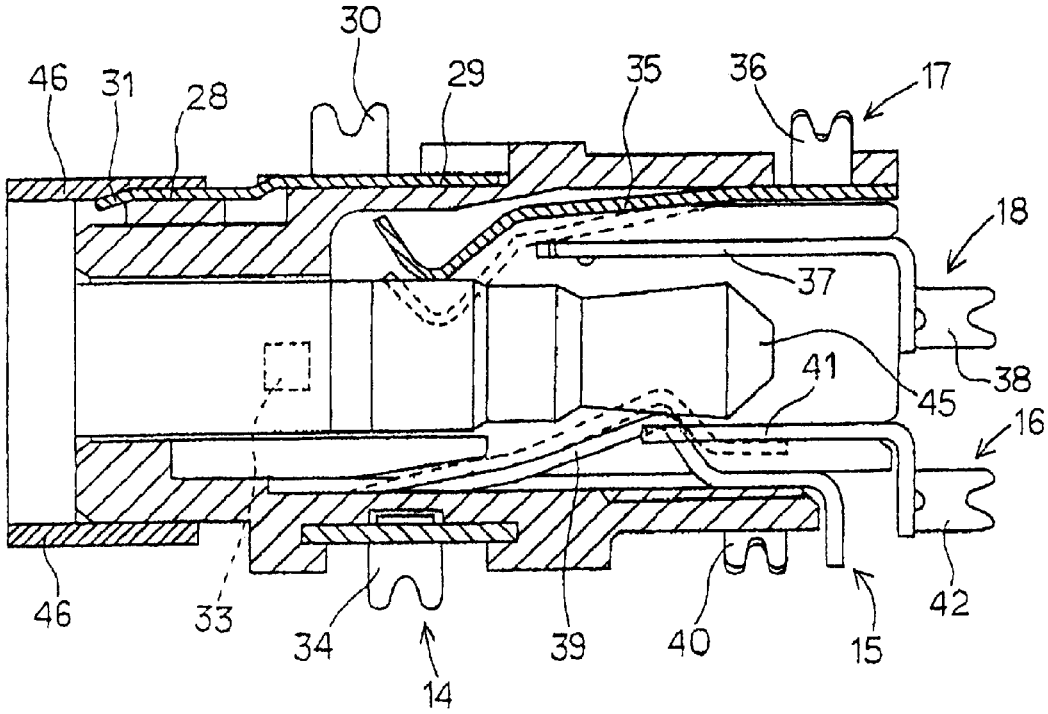
FIG. 6 is another side sectional view showing a plug inserted into the jack.

Referring to FIGS. 1 and 6, housing 10 includes sleeve portion 12, disposed along a front surface side thereof with plug inserting hole 11 disposed therein. A plug 45 is insertable in plug insertion hole 11. Plug insertion hole 11 is integrally formed with a body portion 19. Housing 10 includes a first sleeve spring engaging portion 20 and second sleeve spring engaging portion 21. Also disposed on housing 10 is a ring spring engaging portion 22 and chip spring engaging, portion 23. First sleeve spring engaging portion 20 is disposed on a side surface of body portion 19. Second sleeve spring engaging portion 21 is disposed on the side surface of body portion 19 opposite to first sleeve spring, engaging portion 20.

Ring spring engaging portion 22 is disposed at the rear end of body portion 19 on first sleeve spring engaging portion 20 side. Ring spring 17 is lockingly engaged therewith. Chip spring engaging portion 23 is disposed on the side surface of body portion 19 opposite to ring spring engaging portion 22. Chip spring 15 is lockingly engaged therewith.

Figure 2:
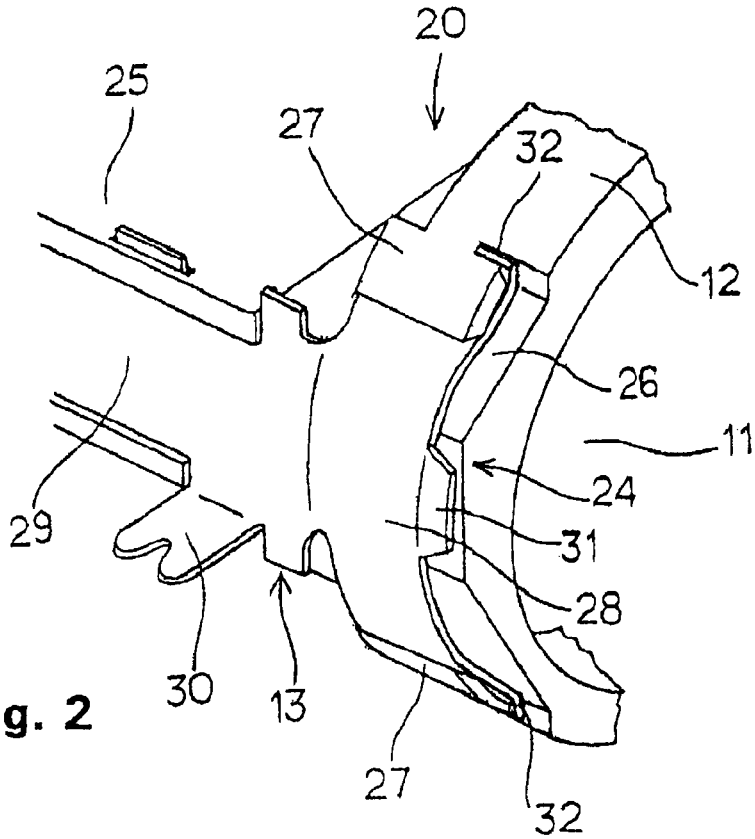
FIG. 2 is an enlarged perspective view of the main portion of the first sleeve spring (plug connecting sleeve spring) in an engaged state disposed along the sleeve portion of the jack.
Figure 3:
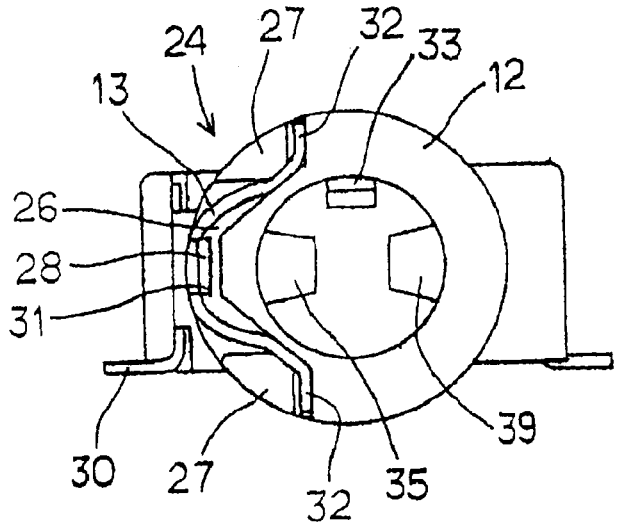
FIG. 3 is an end view of the first sleeve spring (plug connecting sleeve spring) engaged with the sleeve portion.
Figure 4:
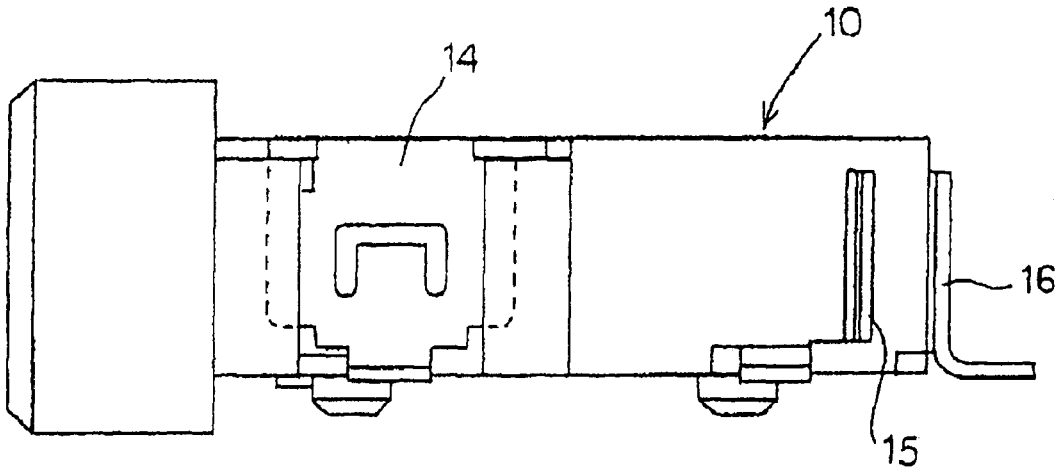
FIG. 4 is a side view of the jack.
Figure 5:
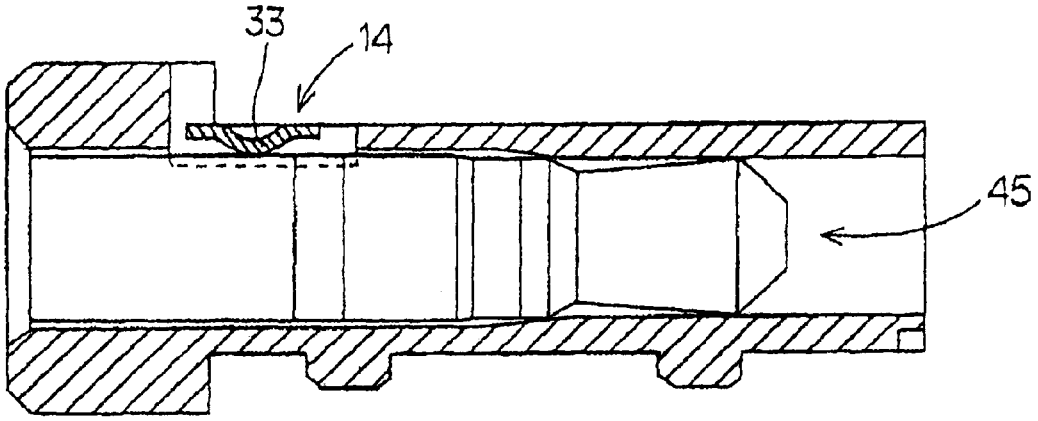
FIG. 5 is a sectional side view showing a plug inserted into the jack.

Referring now to FIGS. 1, 2 and 3, first sleeve spring engaging portion 20 includes a support piece engaging portion 24 and body engaging portion 25. Support piece engaging portion 24 is disposed along the outer periphery of plug inserting hole 11. Body engaging portion 25 is integrally formed with support piece engaging portion 24.

Support piece engaging portion 24 includes a concave portion 26, which is formed by denting a part of sleeve portion 12 along the curved peripheral surface. Convex portions 27 are disposed at both ends of concave portion 26. The central edge of concave portion 26 is chamfered.

First sleeve spring 13 is made by punching and forming a sheet member forming a plug contact portion 28, a body portion 29 and a terminal portion 30.

Plug contact portion 28 is formed by bending the forward extreme end of the sheet member in an arc. Body portion 29 is punched and formed along the rear end of the sheet member. Terminal portion 30 is formed by bending the sheet member at a lower end of body portion 29 outward at right angles. The diameter of plug contact portion 28 is smaller than the diameter of concave portion 26 so that a gap is made when they are engaged with each other.

Plug contact portion 28 is composed of a tongue piece 31 and support pieces 32. Tongue piece 31 is centrally formed along the front edge of plug contact portion 28. Tongue piece 31 is chamfered and slightly bent towards the central axis of plug insertion hole 11. Support pieces 32 are formed by bending both ends of plug contact portion 28 away from the central axis of plug insertion hole 11.

Referring now to FIGS. 1–3 and 6, when a collar 46 of a plug 45 fits over sleeve portion 12 and first sleeve spring 13, plug contact piece 28 is deformed inwards towards concave portion 26. The deflection of contact piece 28 forces support pieces 32 outward towards the inner perimeter of collar 46, holding plug 45 snugly. Because support pieces 32 make contact with the inner perimeter of collar 46 in two places and an opposite edge of sleeve portion 12 is also in contact with collar 46, three contact points are provided on collar 46 when plug 45 is inserted in plug inserting hole 11. Contact portion 28 is elastically deformed by the action of inserting plug 45. Collar 46 first makes contact with the chamfered edge of tongue piece 31 forcing plug contact portion 28 to deflect inward, thus forcing support pieces 32 to move outward, firmly holding plug 45. It is not necessary for support pieces 32 to contact collar 46 since the elastic resilience of contact portion 28 is sufficient to securely hold plug 45 in place.

Referring to FIGS. 1 and 3–6, second sleeve spring 14 includes a contact portion 33 and a terminal portion 34. Contact portion 33 is formed by bending a sheet member at right angles and obliquely extending contact portion 33 toward the front of body portion 19. Terminal portion 34 is formed on the opposite side of contact portion 33 and connectable to an external part. Second sleeve spring 14 is lockingly engaged with second sleeve spring engaging portion 21. Contact portion 33 projects from atop portion of housing 10 down inside the interior space of plug insertion hole 11.

Ring spring 17 is composed of a contact portion 35 and a tongue-shaped terminal portion 36. Contact portion 35 is generally rectangular with a tapered end bent to form a contact. Tongue-shaped terminal portion 36 is formed by bending a tab extending from a side of ring spring 17 at a right angle. Ring spring 17 is inserted into ring spring engaging portion 22 disposed at the rear end of the housing 10. Ring spring 17 is lockingly engaged with spring engaging portion 22 and positioned so that contact portion 35 projects from a left side portion of housing 10 inside the interior space of plug insertion hole 11.

First terminal 18 is composed of a contact portion 37 and a terminal portion 38. First terminal is generally rectangular with a cutout portion. Terminal portion 38 is formed by bending a tab disposed along a rear end of first terminal 18 at a right angle. First terminal 18 is inserted from the rear end into housing 10 with contact portion 37 lockingly engaging with ring spring 17. First terminal 18 is lockingly engaged with housing 10 so that contact portion 37 is in contact with a back surface of contact portion 35 of ring spring 17.

Chip spring 15 is inserted from the rear end of housing 10 and lockingly engaged therewith. Chip spring 15 is generally rectangular and composed of a contact portion 39 and a terminal portion 40. Chip spring 15 is cut and bent to form contact portion 39. Contact portion 39 is bent inward so that it projects into the interior space of plug insertion hole 11. Terminal portion 40 is formed by bending a rear portion of chip spring 15 at a right angle. Contact portion 39 has an apex at an intermediate portion thereof and is tapered from the apex toward the free end which is fork-shaped. Chip spring 15 is inserted into chip spring engaging portion 23 of housing 10 and lockingly engaged therewith.

Second terminal 16 is composed of a fork-shaped contact portion 41 and a terminal portion 42. Contact portion 41 is formed by cutting out an arc in an end of second terminal 16. Terminal portion 42 is formed by bending the base end second terminal 16. Second terminal 16 is lockingly inserted into chip spring 15 from the rear end of housing 10. Contact portion 41 comes into contact with chip spring 15 in such a manner that the slender free end of contact portion 39 of chip spring 15 is held by fork-shaped contact portion 41. That is, second terminal 16 is in electrical contact with chip spring 15 when plug 45 is inserted in plug insertion hole 11.

When first sleeve spring 13 is lockingly engaged with first sleeve spring engaging portion 20, body portion 29 is engaged with body engaging portion 25. Next, support pieces 32 are fitted between convex portions 27 and concave portion 26 of support piece engaging, portion 24 and push-fitted therein. This lockingly engages first sleeve spring 1l3 with housing 10 at three points with tongue piece 31 disposed therein.

When plug 45 is inserted into first sleeve spring 13, which has been lockingly engaged as described above, from the outside, connecting piece 46 makes contact with the end of tongue piece 31. Then, tongue piece 31 deflects and this force is transmitted to support pieces 32. As a result, the diameter of plug contact portion 28 increases by moving toward the gap formed between concave portion 26. Since collar 46 of plug 45 is urged against sleeve portion and plug contact portion 28 by the action of support pieces 32, connecting piece 46 is firmly held against plug contact portion 28.

Further, when connecting piece 46 of plug 45 presses against plug contact portion 28, support pieces 32 move apart in an outward direction causing connecting piece 46 to be firmly held in contact with plug contact portion 28. That is, collar 46 is in contact with elastic plug contact portion 28 through a so-called three-points contact by being pressed by both support pieces 32 which have moved outward. This provides a stable electrical and mechanical contact even when miniaturized.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector jack comprising:

a housing having a sleeve portion:

said sleeve portion has a centrally disposed plug insertion hole communicating with an interior of said housing, whereby a plug is insertable therein;

said plug has a collar axially disposed at one end;

a sleeve spring ill said sleeve portion;

means for resiliently holding said spring in said sleeve portion;

a central contact portion on said sleeve spring;

said sleeve spring has a diameter centered on a longitudinal axis of said jack;

a tongue on said central contact portion;

said tongue is angled centrally inwards whereby said collar is partially aligned with said plug connecting sleeve spring when said collar is pushed against said tongue;

said sleeve spring has a first support piece at one end; and said sleeve spring also has a second support piece at an other end whereby said collar is fitted against said sleeve spring, firmly holding and electrically connecting said plug to said sleeve portion.

2. An electrical connector jack according to claim 1, further comprising:

a plurality of plug connecting springs in said housing; and each one of said plurality of plug connecting springs has a contact facing said cavity whereby electrical contacts are provided to said plug.

3. An electrical connector jack according to claim 1, wherein:

said plug connecting sleeve spring provides three support points including said first support piece, said second support piece and said tongue piece.

4. An electrical connector jack according to claim 1, wherein:

said first and second support pieces extend beyond the surface of said sleeve portion when said collar is fitted against said plug connecting sleeve spring;

said first and second support pieces retract within the surface of said sleeve portion when said collar is removed.

5. A connecting sleeve for installation in an electrical connector jack comprising:

a plug connecting sleeve spring resiliently lodged in a channel of said connecting sleeve;

a terminal on said plug connecting sleeve spring;

said terminal electrically connectable to an external contact;

a tongue on a central portion of said plug connecting sleeve spring;

said central portion being positioned for resiliently urged contact with a connecting portion of said plug inserted into said electrical connector jack; and said resiliently urged contact, forcing said central portion to flex while urging both ends of said plug connecting sleeve spring in an opposite direction toward a perimeter surface of said connecting portion, thereby firmly holding and electrically connecting said connecting portion to said connecting sleeve.

6. An electrical connector jack for receiving a plug comprising:

a housing having a connecting sleeve;

a sleeve spring resiliently lodged in said connecting sleeve;

a terminal on said sleeve spring;

said terminal electrically connectable to an external contact;

a tongue on a central portion of said sleeve spring;

said central portion being positioned for resiliently urged contact with a connecting portion of said plug inserted into said electrical connector jack; and said resiliently urged contact, forcing said central portion to flex while urging both ends of said sleeve spring in an opposite direction toward a perimeter surface of said connecting, portion, thereby firmly holding and electrically connecting said connecting portion to said connecting sleeve.

7. An electrical connector jack according to claim 6, further comprising:

a plurality of plug connecting springs in said housing; and each one of said plurality of plug connecting springs has a contact facing an interior of said housing whereby electrical contacts are provided to said plug when said plug is inserted in said electrical connector jack.

8. An electrical connector jack according to claim 6, wherein:

said both ends of said sleeve spring extend to make electrical contact with said connecting portion of said plug, thereby providing three support and electrical contact points between said plus and said sleeve spring.

9. An electrical connector jack according to claim 1 wherein:

said central contact portion deforms inward towards said longitudinal axis forcing said first and second support pieces to move outward toward said collar, firmly holding, and electrically connecting said plug to said sleeve portion.

* * * * *